US006006046A

United States Patent [19]

MacFarland

[11] Patent Number: 6,006,046

[45] Date of Patent: Dec. 21, 1999

[54] POLICING KEY FOR A TONER CONSUMING MACHINE

[75] Inventor: John B. MacFarland, San Jacinto, Calif.

[73] Assignee: Troy Systems, Inc., Santa Ana, Calif.

[21] Appl. No.: 09/044,481

[22] Filed: Mar. 19, 1998

[51] Int. Cl.[6] ..... G03G 15/00

[52] U.S. Cl. ..... 399/12; 141/364; 141/386; 399/13

[58] Field of Search ..... 399/12, 13, 120; 220/23.86, 6; 222/DIG. 1, 325, 153.06; 141/383, 386, 364; 285/80

[56] References Cited

U.S. PATENT DOCUMENTS

| | | | |
|---|---|---|---|
| 4,478,658 | 10/1984 | Wittwer | 156/69 |
| 4,744,328 | 5/1988 | Stevens et al. | 285/80 X |
| 4,998,666 | 3/1991 | Ewan | 220/602 X |
| 5,100,030 | 3/1992 | Roggenburg et al. | 222/325 X |
| 5,234,732 | 8/1993 | Versic et al. | 428/35.7 |
| 5,293,913 | 3/1994 | Preszler | 141/364 X |
| 5,392,102 | 2/1995 | Toyoizumi et al. | 399/228 |
| 5,559,589 | 9/1996 | Eichberger et al. | 399/119 |
| 5,610,692 | 3/1997 | Trask et al. | 399/262 X |
| 5,666,586 | 9/1997 | Nishimura et al. | 399/13 |
| 5,765,610 | 6/1998 | Brown | 141/384 |
| 5,802,435 | 9/1998 | Trask et al. | 399/224 |

*Primary Examiner*—Matthew S. Smith
*Attorney, Agent, or Firm*—Price, Gess & Ubell

[57] ABSTRACT

A policing key for regulating the type of toner in a copying machine or other toner consuming machine includes a base mounted to the toner-consuming machine and a boss projecting from the base to a position between a port on the machine and a toner bottle cap prior to engagement. The boss protrudes above the periphery of the toner port that contacts an annular brim of the toner bottle cap, precluding the toner bottle from engaging the toner port while the key is in place. Only the annular brim of an approved toner bottle cap, which includes a notch associated with the boss for bypassing the policing key, can be used on in connection with the toner consuming machine. By varying the size and shape of the policing key, the restrictions on the type of toner used in a particular machine can be effectively controlled. In a preferred embodiment, a hardening gel is placed over the base of the policing key such that removal of the base will disturb the hardened gel and indicate a tampering of the key.

6 Claims, 2 Drawing Sheets

POLICING KEY FOR A TONER CONSUMING MACHINE

BACKGROUND OF THE INVENTION

1. Field of the Invention

The present invention relates generally to toner consuming machines such as copiers, printers, facsimile machines, and the like, and more particularly to a policing key for regulating the type of toner introduced in the toner consuming machine.

2. Description of Related Art

The use of toner in paper processing machines to transfer text or images onto stock paper is now commonplace. Toner is a graphite based particulate that bonds to the paper upon application of heat, such as from a laser. Toner-based printing is used in copying machines, stand alone printers, facsimile machines, and a wide assortment of machines designed to process stock or blank paper into paper with print, images, text, or graphics. The methodology behind the laser printing technology is not necessary for an understanding of the present invention and will be omitted for simplicity.

Toner consuming machines can be expensive, requiring a substantial commitment of capital for the small business owner. Additionally, the advances in technology often make it impractical for a small business owner to invest in technology which may become outdated in the near future. For these reasons, many companies lease or rent printers, copying machines, and other toner consuming equipment from retailers or manufactures rather than purchase the equipment outright. A common practice in these arrangements is an agreement that repairs will be the responsibility of the leasor while the maintenance and its associated costs are borne by the small business leasing the equipment. Among the requirements of the machine's user is to replace the toner supply when it is depleted.

Some toner consuming machines require a special type of toner in order to function properly, and the use of a ordinary toner can damage the equipment or cause substandard performance and the need for servicing. Unfortunately, the leasee of the toner consuming machine may be tempted to use a toner which is less expensive or more readily available since initially the results may not demonstrate a difference in product quality. However, the use of non-approved toner in these machines eventually results in poor performance and customer dissatisfaction. The problem persists, however, because most varieties of toner (both "special" and standard) use a common bottle design suited for this particular application. These toner bottles features a cap specially sized to fit into a port on the machine and engage the port. The cap allows the toner bottle to be inverted for vertical delivery without spilling the toner prior to introduction. The use of this bottle cap on both special and standard toner bottles permits the inadvertent or misuse of non-approved toner in a machine requiring only special or approved toner. This results in significant costs to the party responsible for maintenance, which must continually repair the toner consuming machines due to the use of non-approved toner.

OBJECTS AND SUMMARY OF THE INVENTION

Thus, it is an object of the present invention to provide a policing key and system for preventing the introduction of non-approved toner in a machine requiring only a special approved toner.

It is another object of the present invention to provide an inexpensive and tamper-resistant system for regulating proper toner use in a toner consuming machine.

It is yet another object of the present invention to provide a system which is readily adaptable to existing toner machines.

These objects are achieved by a policing key mountable on a toner consuming machine adjacent the orifice or port for receiving the toner bottle cap. The policing key includes a base mounted to the toner-consuming machine and a boss projecting from the base to a position between the port and a toner bottle cap prior to engagement. The boss protrudes above the periphery of the toner port that contacts the annular brim of the toner bottle cap, precluding an ordinary toner bottle from engaging the toner port while the key is in place. Only the annular brim of an approved toner bottle cap, which includes a notch associated with the boss for bypassing the policing key, can be used on in connection with the toner consuming machine. The policing key thus regulates the type of toner used in a particular machine and inhibits the use of an improper toner. The approved bottle cap is not impeded by the policing key, thereby insuring that only an approved bottle cap engages the port. By varying the size and shape of the policing key, the restrictions on the type of toner used in a particular machine can be effectively controlled. In a preferred embodiment, a hardening gel is placed over the base of the policing key such that removal of the base will disturb the hardened gel. In this manner, one can determine if the policing key has been removed or tampered with, thus improving the integrity of the system.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a policing key and system for regulating the type of toner introduced into a toner consuming machine.

Figure 1:
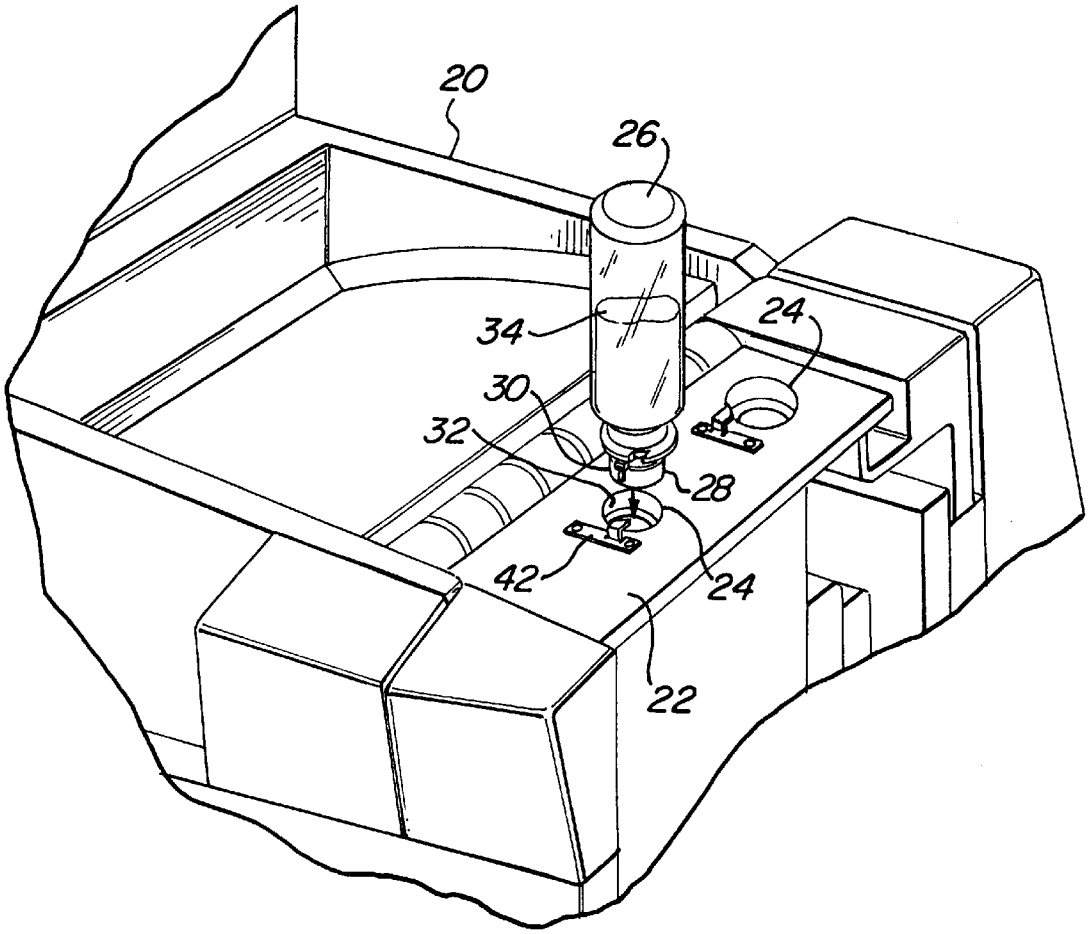
FIG. 1 is an elevated perspective view of a toner consuming machine with the toner port exposed and the present invention in place, and with an approved toner bottle above said port.
Figure 2:
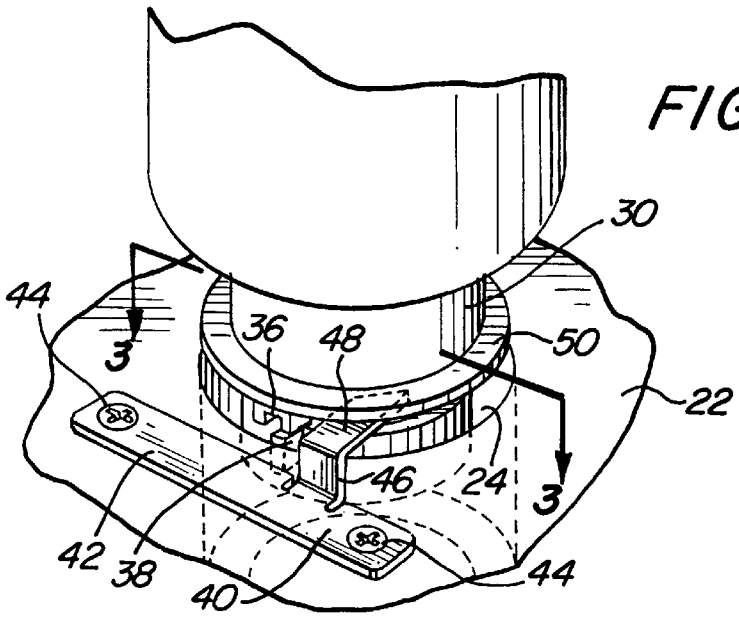
FIG. 2 is an elevated perspective view, partially in phantom, of an ordinary toner bottle prevented from engagement with the toner port by the present invention.

A typical toner consuming machine, here a copying machine 20, is illustrated in FIG. 1. The toner consuming machine includes a panel 22 where toner may be introduced to replenish a diminished supply through a designated port 24. Shown here are two such ports 24, as may be the case where two types of toner are required of the particular machine. Toner bottles 26 are designed to be inverted over the designated port 24 and engaged with the port by inserting the head 28 of the cap 30 into a well 32 adapted to receive the head 28. The cap 30 is initially closed to prevent spillage of the toner 34, and is opened only once the toner bottle 26 is fully engaged in the port 24 and rotated approximately 180 degrees. In FIG. 2, a slotted member 36 on the side of the cap is used to position the bottle, and lid fitted over the cap head 28 rotates freely thereabout. A tab 38 on the lid is fixed when the bottle is engaged properly in the toner port 24 such that when the toner bottle is rotated, the lid is held stationary. The relative rotation of the bottle cap and the lid thereon causes an overlapping shield to withdraw, exposing the interior of the bottle to the toner port.

Figure 3:
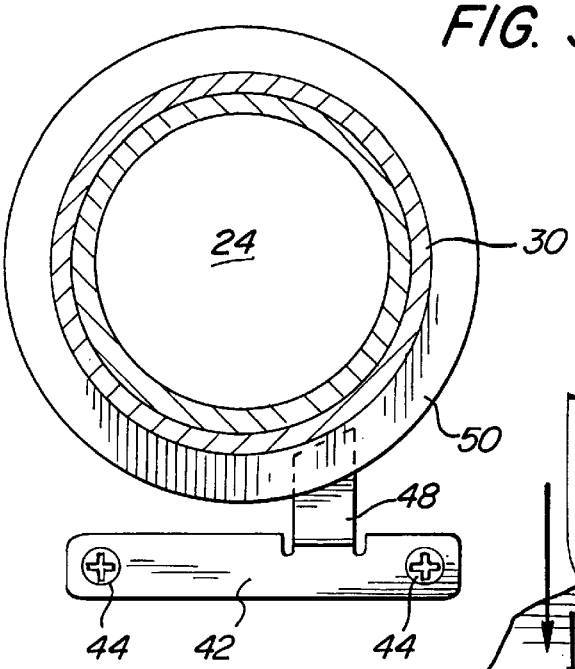
FIG. 3 is a cross-sectional view from FIG. 2 looking downward onto the toner port illustrating the overlap between the non-approved toner bottle cap and the policing key of the present invention.

As shown in FIG. 2, the present invention is a policing key 40 that comprises a base 42 which is secured to the panel 22 of the toner consuming machine 20 and adjacent the toner port 24. It is to be understood that the base 42 can be mounted to the panel 22 in any number of ways without deviating from the scope of the invention, including fasteners 44 (as shown), adhesives, rivets, bonding, or the base 42 may be integral with the panel itself. The policing key 40 may be pressed from a single sheet of metal such as stainless steel, or any suitable material which possesses the desired rigidity and is cost effective. A vertical spacing member 46 is formed by routing the projection away from the base 42, which provides a vertical gap that allows the toner bottle cap to turn without interference once the toner bottle cap 30 has bypassed the policing key 40 and is engaged with the toner port 24. A boss 48 is then formed by redirecting the projection to its original direction generally parallel with the plane of the panel 22. The boss 48, as shown from above in FIG. 3, extends over the periphery of the toner port under the annular brim 50 of the superimposed toner bottle cap, but does not extend over the port 24 itself. As can be seen in FIG. 2, the boss 48 intercedes between, and thus interferes with, the engagement of the toner bottle cap 30 with the toner port 24. An ordinary (and consequently an unapproved) toner bottle cap 30 such as that depicted in FIGS. 2 and 3 cannot engage the toner port 24 in an ordinary manner due to the policing key 40, thereby regulating the type of toner used in the toner consuming machine.

Figure 4:
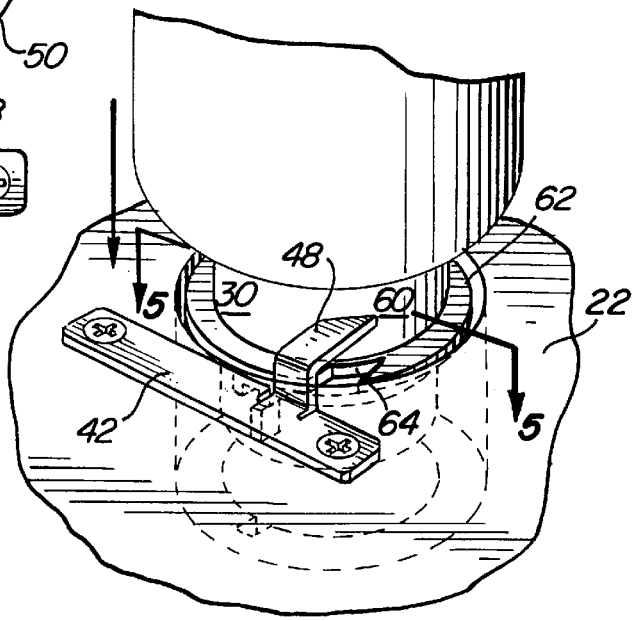
FIG. 4 is an elevated perspective view, partially in phantom, of the engagement of an approved toner bottle cap with the toner port.

Turning to FIG. 4, a toner bottle cap 60 has been modified in accordance with the policing key 40, designating its status as a "special" or "approved" toner. The modification is directed to the annular brim 62 of the toner bottle cap, which now includes a notch 64 that matches the boss 48 of the policing key 40. The notch 64 allows the toner bottle cap 60 to bypass the policing key 40 and engage the toner port 24. Once the toner bottle cap 60 bypasses the policing key boss 48, it can be operated in its ordinary manner. The shape of the boss tip 66 and the notch 64 can vary from the shape shown, as long as the boss 48 and notch 64 have cooperating shapes. Different shapes can be assigned to different toners to further regulate the type of toner introduced into the toner consuming machine.

Figure 5:
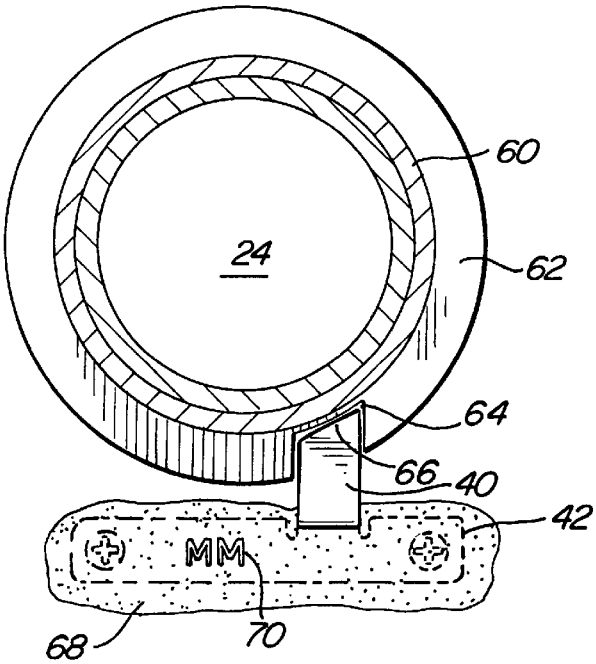
FIG. 5 is a cross-sectional view from FIG. 4 looking downward onto the toner port illustrating the cooperation of the present invention with a toner bottle cap of an approved toner thus allowing engagement, and a tamper gel over the base of the policing key.

FIG. 5 illustrates the clearance between the boss 48 and the notch 64 as an approved toner bottle engages the toner port 24. In a preferred embodiment, a solidifying gel 68 is placed over the base 42 of the policing key 40 and allowed to harden. The placement of the gel 68 over the base 42 inhibits the removal of the policing key in order to bypass the system because removing the base 42 will perceptively disturb the gel 68. This disruption indicates to a repair person that the policing key 40 has been tampered with and conditions of a maintenance agreement may be violated. To further resist tampering, an impression 70 may be made into the gel 68 such as a logo or emblem which would make it difficult to recreate should the base be removed improperly. The gel is preferably a fast-drying lacquer such as that manufactured by Organic Products Company of Irving, Tex., under the tradename "Guard of Quality," but any suitable substitute material can be used.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A policing key for a toner consuming machine comprising:

a base mounted to said toner consuming machine;

a boss projecting from said base to a position adjacent a toner bottle engagement port on said toner consuming machine, said boss preventing engagement of said port with a toner bottle having a complete annular brim while permitting engagement of a toner bottle having a brim including a notch corresponding to said boss; and a solidifying gel disposed over said base, said gel, once solidified, indicating a tampering of the policing key.

2. The policing key of claim 1 further comprising an identifying insignia formed in said solidifying gel.

3. The policing key of claim 1 wherein said base and said boss are connected by a substantially vertical spacing member.

4. The policing key of claim 3 wherein said base, said boss, and said vertical spacing member are integrally constructed from a single sheet.

5. A system for regulating the type of toner bottle to be used in connection with a toner consuming machine comprising:

an elongate metallic base rigidly secured to said toner consuming machine adjacent a port for receiving a toner bottle, said elongate metallic base further comprising a cover of solidifying gel disposed over an upper surface wherein said cover of solidifying gel, once solidified, indicating whether said elongate metallic base has been tampered with;

an elongate boss extending from said elongate metallic base, with proximal and distal ends relative to said elongate metallic base, said distal end projecting above said port; and a toner bottle having an annular brim with a notch shaped to pass said distal end of said elongate boss therein-through when said toner bottle is placed in an operable position within said port for receiving the toner bottle.

6. The system for regulating the type of toner bottle to be used in connection with a toner consuming machine as recited in claim 5 wherein said distal end of said elongate boss has a unique shape corresponding to a matching unique notch shape on an authorized toner bottle annular brim.

* * * * *